United States Patent [19]

Birdsall et al.

[11] 4,224,760

[45] Sep. 30, 1980

[54] BUBBLE-BLOWING DOLL

[75] Inventors: John Birdsall, Los Angeles, Calif.; Thomas Fauls, West Orange, N.J.

[73] Assignee: Mego Corp., New York, N.Y.

[21] Appl. No.: 1,594

[22] Filed: Jan. 8, 1979

[51] Int. Cl.[3] ..... A63H 13/00

[52] U.S. Cl. ..... 46/116; 46/44

[58] Field of Search ..... 46/88, 44, 116, 87, 46/117

[56] References Cited

U.S. PATENT DOCUMENTS

| | | | |
|---|---|---|---|
| 1,163,368 | 12/1915 | Rosofsky | 46/117 |
| 1,547,354 | 7/1925 | Baum | 46/117 |
| 2,565,679 | 8/1951 | Dunn et al. | 46/90 |
| 3,534,495 | 10/1970 | Goldman | 46/44 UX |
| 3,721,039 | 3/1973 | Cook et al. | 46/44 X |

*Primary Examiner*—Robert Peshock
*Assistant Examiner*—Mickey Yu
*Attorney, Agent, or Firm*—Bertram Frank

[57] ABSTRACT

A bubble-blowing doll has a body which includes a trunk, two arms and two legs movably connected to the trunk, and a head also connected to the trunk and having a mouth opening. One of the arms rotates a ratchet wheel of a ratchet mechanism which, in turn, rotates a pulley about which a rope is wound during the operation of the ratchet mechanism. A bellows is mounted in the trunk, its upper end being stationary and its lower end being movable toward and away from the upper end, and the rope is connected to the lower end of the bellows, while a spring biases the lower end away from the upper end of the bellows. A conduit communicates the interior of the bellows with the interior of a balloon an open end of which is mounted on a reed and a distensible end of which is located at a free end of the reed and at the mouth opening of the head in a deflated condition, and at the exterior of the head next to the mouth opening in the inflated condition of the bellows. An ejector is slidably mounted in a mouth-piece which surrounds the reed and has an actuating portion at the exterior of the head which can be actuated to eject the reed and the balloon mounted thereon through the mouth opening.

18 Claims, 5 Drawing Figures

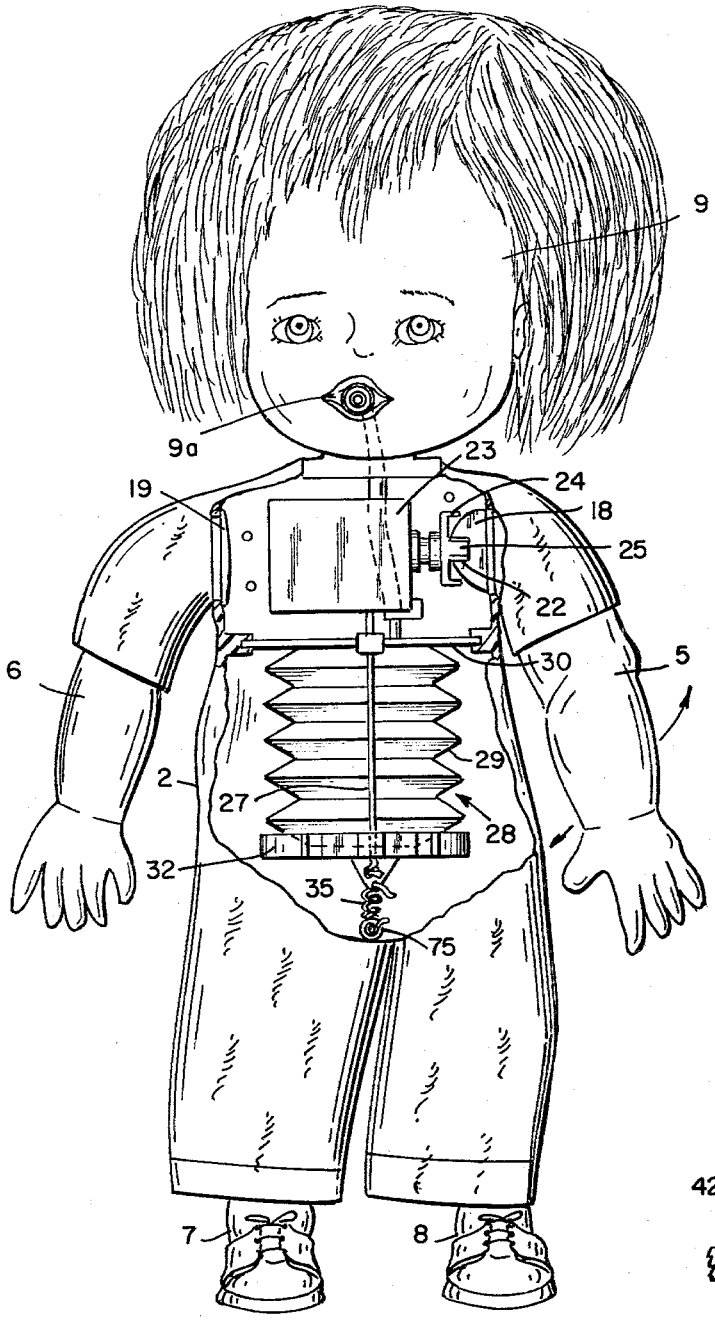
FIG. 1
FIG. 3
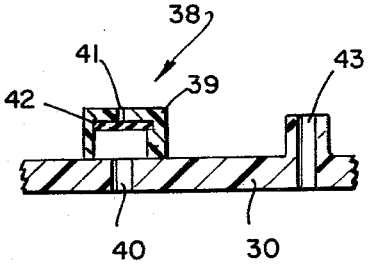

BUBBLE-BLOWING DOLL

BACKGROUND OF THE INVENTION

The present invention relates to children's toys in general, and more particularly to activity dolls.

Various types of activity dolls are already known and readily available on the market. These activity dolls, unlike the conventional dolls in which at most the limbs are movably mounted on the trunk or the eyes open and close in dependence on the position assumed by the doll, perform various activities when activated. Basically, these activity dolls fall into two categories, namely the usually battery-powered automatic dolls which only require the original activation to perform their intended movements or series of movements, and manually operated activity dolls which require a concentrated effort on the part of the children playing with them before performing their desired tasks. The dolls falling into the first category do not require any collaboration on the part of the children as they perform their various activities, such as walking, crawling, swimming or the like, except for the initial activation. On the other hand, the second-mentioned category of the activity dolls, into which the doll of the present invention belongs, is much more challenging and even educational to the children, inasmuch as it teaches them concentration, coordination of movements and the rewards of persistence, that is, the feeling of joy or even pride when the effort is crowned with success.

A particular advantage of the activity dolls or similar toys of the second category is that they improve the skills and mental capabilities of the children in an innocuous, hardly perceptible and, what is more, enjoyable way. This is particularly true when the activity doll or toy engages in an activity or in activities with which the child can identify, especially in an activity which the child encounters quite often in the real life. Inasmuch as children of tender, and even of not so tender years have a tendency to engage in the same or similar activities as those which they see around them, dolls become surrogate children to them so that, ideally, activity dolls should engage in the same activities as real children do.

SUMMARY OF THE INVENTION

Accordingly, it is a general object of the present invention to avoid the above-mentioned disadvantages of the conventional dolls and also of the activity dolls of the first-mentioned category.

It is a further object of the present invention to provide a doll of the second-mentioned category which adds to the repertory of activities in which the dolls of this type can engage.

A further object of the invention is to develop a doll which is at least somewhat challenging to the child playing with it but which, moreover, brings enjoyment to the child.

A concomitant object ofthe invention is to so construct the new activity dolls as to be rugged, quite inexpensive to manufacture, reliable, and quite but not too easy to operate.

In keeping with these objects and with others which will become apparent hereafter, the present invention provides a bubble-blowing doll. Inasmuch as blowing bubble gum bubbles is a favored activity of many children, a doll engaging in this activity has a pronounced appeal not only to these children but also to those who, for one reason or another, do not engage in this activity themselves.

As usual, the doll comprises a body which includes a head and four limbs, that is, two arms and two legs. The head includes a mouth opening which communicates the interior with the exterior of the head. Then, a balloon having an open end and distensible end which is remote from the open end is so mounted on the body that the open end is located within the body, particularly within the head and the distensible end is situated at the mouth opening. Means is provided for introducing a pressurized medium into the balloon through the open end to inflate the distensible end to the exterior of the head at the mouth opening when the introducing means is energized by energizing means.

More specifically, the introducing means includes means in the body for pressurizing the medium, and means for communicating the pressurizing means with the interior of the balloon. The energizing means includes an actuator extending between the exterior and the interior of the body and connected to the pressurizing means. Because of the provision of the pressurizing means within the body there is no need for providing any external source of the pressurized medium. On the other hand, the provision of the actuator which extends to the exterior of the body renders it possible to energize the pressurizing means despite the fact that the same is fully accommodated within the body.

According to an advantageous aspect of the present invention, the pressurizing means includes a bellows and the actuator includes a ratchet mechanism including a ratchet wheel mounted in the body for rotation about an axis and an arresting pawl which engages the ratchet wheel, and permits the same to rotate in only one sense. The actuator further includes a transmission interposed between the bellows and the ratchet mechanism, which transmission compresses the bellows when the ratchet wheel rotates in the above-mentioned one sense. As a result of this construction of the pressurizing means and of the actuator, it is assured that the operation of these components will be simple, smooth and reliable.

According to a particular concept of the present invention, the transmission includes a pulley connected to the ratchet wheel for joint rotation therewith at least in the above-mentioned one sense, but preferably in both senses and at least one flexible element which is so connected to the pulley as to be wound thereabout during the rotation of the pulley in the one sense. The flexible element is so connected to the bellows, preferably at more than one location, as to compress the bellows during the winding of the flexible element about the pulley. The construction of the transmission as a flexible element cooperating with a pulley is very simple, but also extremely durable.

It is further proposed by the present invention that the ratchet mechanism further include an entraining pawl which has at least one tooth and that the ratchet wheel has at least one detent, but preferably there will be more than one of the teeth or detents or both. The entraining pawl is mounted on the body of the doll for rotation in both senses about the axis of the ratchet wheel, so that the tooth or teeth of the entraining pawl engages or engage the detent or detents of the ratchet wheel when the entraining pawl rotates in the above-mentioned one sense, and disengages or disengage the detent or detents when the entraining pawl rotates in the opposite sense. In this manner, there is obtained a unidirectional rotation of the ratchet wheel inasmuch as the entraining pawl will entrain the ratchet wheel for rotation only in the one sense and the arresting pawl will prevent the ratchet wheel from rotating in the opposite sense even when the entraining pawl rotates in such an opposite sense. As a result of this, it is possible or even necessary to perform the compression of the bellows in several phases during each of which the entraining pawl moves through a full cycle in the one and then in the opposite direction, while the ratchet wheel is entrained for joint rotation with the entraining pawl only while the latter rotates in the one sense.

Advantageously, the entraining pawl has a disc-shaped portion having an axial end face carrying the tooth or teeth and the ratchet wheel has an end surface which is juxtaposed with the end face of the disc-shaped portion and carries the detent or detents. Under these circumstances, it is advantageous when the entraining pawl is mounted on the body of the doll for displacement axially toward and away from the ratchet wheel, and when means is provided for axially displacing the entraining pawl at least in direction away from the ratchet wheel and for simultaneously disengaging the arresting pawl from the ratchet wheel for release of the same for rotation in the opposite sense. It is further advantageous when the displacing means includes a support member mounted on the body for movement in and opposite to the above-mentioned direction, the support member carrying the arresting pawl for joint movement and engaging the entraining pawl on movement in the one direction. The displacing means then includes an operating member which has an actuating portion accessible at the exterior of the body of the doll and an operating portion which acts on the support member for moving the same at least in the above-mentioned direction upon actuation of the operating member. Then, it is further proposed by the present invention for the displacing means to further include means for urging the entraining pawl and the support member opposite to the above-mentioned direction. The urging means includes at least one spring which acts on the entraining pawl, but preferably also another spring which acts on the support member. The construction which has been discussed just above renders it possible to release the ratchet wheel for rotation in the opposite sense, as a result of which the flexible element will unwind itself from the pulley and the bellows will expand, resulting in a deflation of the balloon.

In accordance with a further facet of the present invention, one end portion of the bellows is stationarily mounted in the body of the doll and the other end portion of the bellows is capable of moving toward and away from the one end portion of the bellows during the compression and expansion of the bellows. Under these circumstances, it is advantageous when the transmission further includes an end member which is guided in the body of the doll for movement toward and away from the above-mentioned one end of the bellows, the end member being connected to the flexible element and extending across the other end of the bellows to act on the same at least while moving toward the one end of the bellows. In this manner, it is assured that the flexible element will properly act on the other end of the bellows at least during the compression, but preferably also during the expansion of the bellows. While the inherent resiliency of the bellows could be utilized for returning the end member into its initial position, the operation of these components is even more reliable when means is provided for biasing the end member away from the one end of the bellows, the biasing means including at least one spring which is connected to and extends between the end member and the body. Then, the resiliency of the bellows, together with the resiliency of the balloon, are used for merely expanding the bellows once the end member ceases to act on the other end of the bellows and is withdrawn by the biasing means following the release of the ratchet mechanism for rotation in the opposite sense.

While it would be possible, at least theoretically, to operate the bellows, the balloon and the components which communicate the interior of the bellows with the interior of the balloon as a closed system, this would be less than completely satisfactory inasmuch as it would require that the bellows be always in its fully expanded condition when the balloon is being replaced, for instance, after bursting, and that the system be absolutely hermetically sealed. Were it otherwise, it could happen that the balloon would be aspirated into one or more of the parts which establish the communication between the bellows and the balloon and thus at least the size of the bubble would be diminished, if not the balloon damaged. To avoid this possibility, the pressurizing means includes, according to a further development of the present invention, a one-way valve which is interposed between the interior and the exterior of the bellows and which permits ambient air to enter the interior of the bellows when subatmospheric pressure prevails therein while preventing pressurized air from escaping through the one-way valve to the exterior of the bellows.

In a currently preferred embodiment of the present invention, at least one of the limbs, but preferably all four is or are mounted on the trunk of the body at least for a limited swiveling movement relative to the trunk. According to the invention, the swivelable limb or one of the swivelable limbs, preferably one of the arms, constitutes a part of the actuator. When this expedient is resorted to, it is not necessary to provide any additional part of the actuator which is accessible at the exterior of the body of the doll.

In a further development of this concept, it is advantageous when the rim which constitutes a part of the actuator has a transverse recess at that portion thereof which is received within the trunk, which recess receives an elongated protuberance of the ratchet mechanism for joint swiveling with the one limb, the protuberance driving the ratchet wheel in rotation about the above-mentioned axis.

It is further advantageous for the communicating means to include a conduit and a reed which is sealingly mounted on and embraces a portion of the conduit, the open end of the balloon being mounted on the reed. It is particularly advantageous, in this context, to provide the reed with an external circumferential rim, and to have the open end of the balloon engage behind the circumferential rim. Then, the other, free end of the reed is advantageously substantially flush with the mouth opening of the head. In this manner, the one end of the balloon is securely mounted in the interior of the head, while the distensible end of the balloon is located at the mouth opening of the head.

As mentioned previously, it may happen that the balloon ruptures by being punctured or otherwise mishandled, or because of the failure of the material of the balloon after a period of use thereof or because of latent fault in the material. Under these circumstances, it is necessary to substitute an intact balloon for the damaged one. Thus, the doll of the present invention is further provided with means for ejecting the reed with the balloon mounted thereon to the exterior of the head of the doll through the mouth opening. Advantageously, the ejecting means includes an ejecting member which is mounted in the head of the doll for movement along that portion of the conduit on which the reed is mounted. Preferably, the ejecting member has an actuating end, especially an actuating button, at the exterior or interior of the head substantially opposite the mouth opening. Thus, during the movement of the ejecting member in the forward direction, it will push the reed forwardly off the above-mentioned portion of the conduit and out of the mouth opening.

It is further advantageous when, in accordance with an additional concept of the present invention, a mouth piece is provided within the head which partially surrounds the conduit and fully accommodates the reed, the mouth piece having an open end which is substantially flush with the mouth opening of the head. The mouth piece confines the portion of the balloon which is located within the head of the doll between itself and the reed, so that the balloon cannot undesirably expand within the head. However, the mouth piece preferably also serves a different purpose, and that of guidance of the ejecting member during its movement, in that the ejecting member is partially accommodated in the mouth piece.

Accordingly, the invention consists in the features of construction, combination of elements, and arrangement of parts which will be exemplified in the article of manufacture hereinafter described and of which the scope of application will be indicated in the appended claims.

BRIEF DESCRIPTION OF THE DRAWINGS

In the accompanying drawings, in which the currently preferred embodiment of the present invention is shown:

FIG. 1 is a front elevational view of the doll of the present invention with a part of its body removed to offer view into the interior of the doll;

FIG. 3 is a sectional view of a detail A of FIG. 2;

DETAILED DISCUSSION OF THE PREFERRED EMBODIMENT

Figure 2:
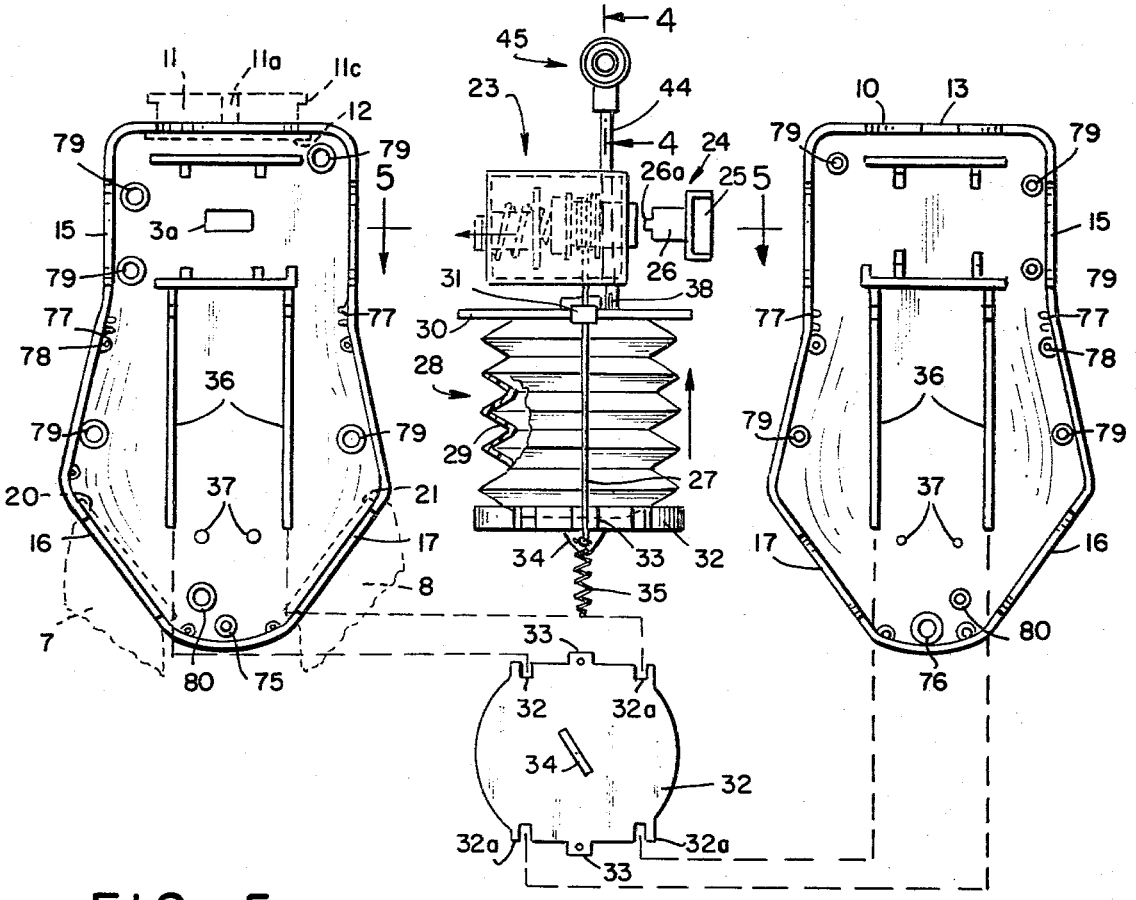
FIG. 2 is an exploded view of most of the components which together constitute the doll.

Referring now to the drawing in detail, and first to FIG. 1 thereof, it may be seen that the reference numeral 1 has been used to indicate a doll of the present invention in its entirety. The doll is illustrated in FIG. 1 in its assembled and clothed condition. Of course, the articles of clothing may be arbitrarily selected and may be of various colors and styles.

As also shown in FIG. 1, the doll has a body which includes a trunk or torso 2 to which there are connected, in a swiveling manner, two arms 5 and 6 and two legs 7 and 8. A head 9 is also connected to the trunk 2, either rigidly or for a limited turning relative thereto. The head 9 has a mouth opening 9*a*.

A part of the trunk 2 of the doll has been removed in order to make some components accommodated within the trunk visible. First of all, it is to be mentioned that, as stated before, at least one but preferably all of the limbs 5 to 8 are swivelably mounted on the body 2. As a comparison of FIGS. 1 and 2 will reveal, the trunk 2, which consists of two shells 3 and 4, is provided with respective openings 14, 15, 16 and 17 in which the limbs 5, 6, 7 and 8 are respectively partially received. Of course, the limbs 5 to 8 have to be retained in the openings 15 to 17, respectively. To this end, the limbs 5 to 8 have respective collars 18, 19, 20 and 21 which engage behind the shells 3 and 4 around the openings 14 to 17 in the assembled condition of the doll.

As further illustrated in FIG. 2, the trunk 2, or the shells 3 and 4 constituting the same, has a further opening 10 which receives, in the assembled condition, a neck piece 11 having a collar 12 which engages behind the trunk 2 around the opening 10. In this manner, even the neck piece 11 is prevented from extraction. The neck piece 11 has respective projections or ribs 11*a*, 11*b* (see FIG. 4) which are received in respective recesses 13 which open into the opening 10. The ribs 11*a* and 11*b* prevent the neck piece 11 from rotating relative to the body 2. The recesses 13 could accommodate all of the ribs 11*a* and 11*b* and the recesses could be so configurated as to fittingly receive the ribs 11*a* and 11*b*. However, as illustrated, only the rib 11*a* is long enough to be received in the recess 13, while the rib or ribs 11*b* terminate upwardly of the trunk 2. Then, the recess 13, in this embodiment a single one, has a circumferential dimension exceeding that of the rib 11*a* so that the latter is accommodated therein for limited turning of the neck piece 11 relative to the trunk 2. In this manner, the head 9 which is mounted on the neck piece 11 in a manner yet to be described can be turned to a limited extent relative to the body 2, together with the neck piece 11. The neck piece has a rim 11*c* and the head 9 has a bulge which surrounds, in a manner which has not been illustrated in order not to unduly encumber the drawings, an opening of the head 9 which receives the neck piece 11. Also in a non-illustrated manner, the bulge of the head 9 is interrupted by recesses which receive the ribs 11*a* and 11*b* in a fitting manner so that the ribs 11*a* and 11*b* prevent relative rotation between the head 9 and the neck piece 11.

Returning now to FIG. 1, it will be further seen therein that the collar 18 of the arm 5 is configurated as a bulge which has a transverse recess 22. A ratchet mechanism which will be discussed in more detail later on, has been indicated in its totality by the reference numeral 23. A connecting member 24 which is connected to the ratchet mechanism 24 for joint rotation has an elongated bulge 25 which is received in the transverse recess 22 of the arm 5, so that the swiveling motion of the arm 5, indicated by the arrow, will be transmitted to and converted into rotation of the connecting member 24 and thus of the ratchet mechanism 23. The connecting member 24 further has a portion 26 (FIG. 2) which is received, in a rotation-transmitting manner but with freedom of axial movement, in the ratchet mechanism 23 (compare FIGS. 2 and 5).

As also seen in FIGS. 1 and 2, a flexible element 27, such as a string or a rope, emerges from the ratchet mechanism 23. The flexible element 27 is connected to a pressurizing arrangement 28 which includes as one of its main components, a bellows 20. An upper end plate 30 is rigidly connected to the upper end of the bellows 29 and has two eyelets 31 through which the flexible element 27 passes at the opposite sides of the bellows 29. A lower end plate or member 32 abuts the lower end of the bellows 29, and the two ends of the flexible element 27 pass through eyelets 33 and are attached thereto, for instance, by having knots at or close to the respective ends thereof. The lower end plate 32 has a projection 34 to which one end of a spring 35 is affixed, whose other end is mounted on a pin 75 or the pin 76 of the shell 3 or 4. Thus, the spring 35 pulls the lower end plate 32 in the downward direction.

The lower end plate 32 has recesses 32*a*, and the shells 3 and 4 have respective guide projections 36 which are received in the respective recesses 32*a* of the lower end plate 32. Pins 37 delimit the extent of the downward movement of the lower end plate 32.

As illustrated in FIG. 3, the upper end plate 30 of the pressurizing arrangement 28 has a one-way valve 38 mounted thereon. The one-way valve 38 has a housing 39 bounding an interior which communicates with the interior of the bellows 29 through an orifice 40, and with the exterior of the bellows 29 through an aperture 41. A plate valve member 42 is resiliently mounted within the housing 39 and is capable of yielding and thus admitting ambient air into the interior of the bellows 29 when the pressure in the latter drops below the atmospheric pressure. As also seen in FIG. 3 the upper end plate 30 has a nipple 43.

Figure 4:
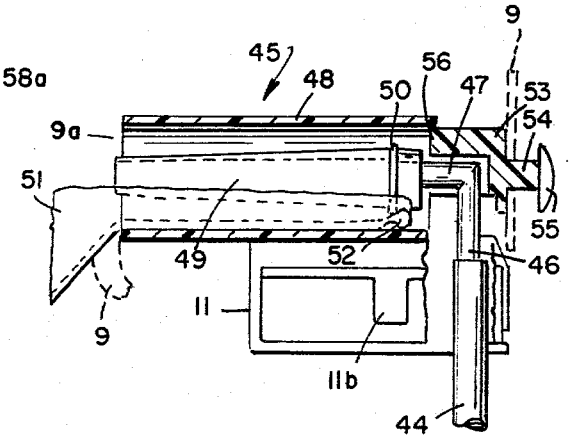
FIG. 4 is a sectional view taken on line 4—4 of FIG. 2.

As illustrated in FIG. 2, a flexible tube 44 is sealingly mounted on the nipple 43 and leads to a balloon-mounting arrangement 45 which is revealed in more detail in FIG. 4. The arrangement 45 includes an L-shaped pipe 46 which has the tube 44 connected to its lower end, also in a sealing manner, and includes a mounting portion 47 which extends toward the mouth opening 9*a* of the head. A mouth piece 48 partially surrounds the mounting portion 47 of the duct 46 and extends so far toward the mouth opening 9*a* as to be substantially flush therewith. A reed 49 is sealingly mounted on the mounting portion 47 of the duct 46 and extends forwardly therefrom toward the mouth opening 9*a* in such a manner as to be also substantially flush therewith. A partially illustrated balloon 51, shown in its inflated position at and around the mouth opening 9*a* of the head 9, has a bulge 52 which sealingly engages behind the rim 50 of the reed 49. The mouth piece 48 confines the balloon 51 between itself and the reed 49 in the interior of the head 9 so that the balloon 51 will not be able to unduly expand in the head 9.

An ejector 53 is slidably mounted in the mouth piece 48 and has a stem 54 which may pass through the rear wall of the head 9 and is provided with a mushroom-shaped head or button 55. When the bottom 55 is depressed in the frontward direction, and end face 56 of the ejector 53 will contact the reed 49 and expel the same frontwardly of the mouth opening 9*a* of the head 9.

It will be already appreciated from the foregoing discussion that the bellows 29, the tube 44, the duct 46, the interior of the reed 49 and the interior of the balloon 51 constitute a substantially closed system, except that the valve 38 will replenish the amount of air in the system should the pressure in the system drop, for whatever reason, below the atmospheric pressure. Thus, the maximum extent to which the distensible end of the balloon 51 can be inflated will be determined by, and only by, the capacity of the bellows 29. Thus, the distensible portion of the balloon 51 cannot ever be overinflated.

Figure 5:
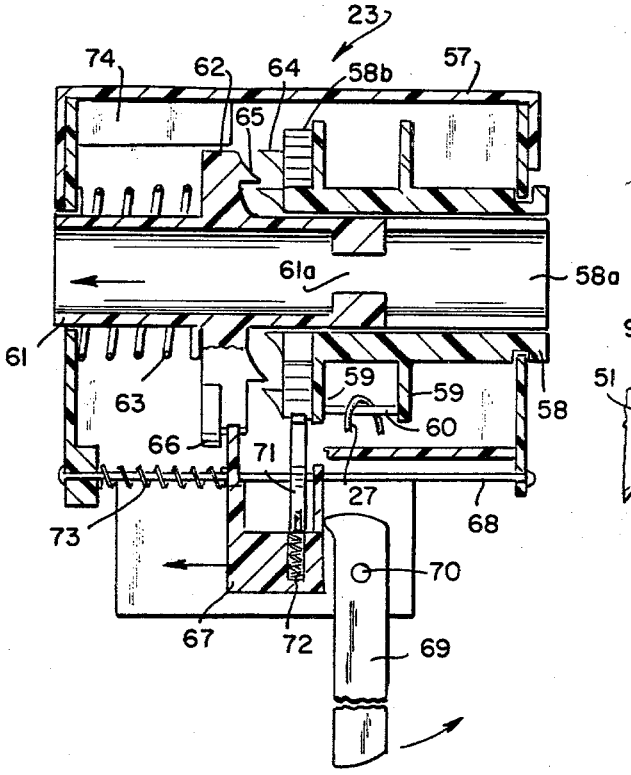
FIG. 5 is a sectional view taken on line 5–5 of FIG. 2.

Turning now to FIG. 5, it may be seen therein that the ratchet mechanism 23 includes a housing 57 which rotatably accommodates a ratchet member 58. The ratchet member 58 is hollow and bounds a passage 58*a* which accommodates the portion 26 of the connecting member 24 in the assembled condition. The ratchet member 58 is further provided with a ratchet wheel 58*b*. Two walls 59 of the ratchet member 58 together bound a recess and form a pulley. A connecting yoke 60 is connected to and extends between the projections 59. The flexible element 27 is trained about the yoke 60 and is convoluted about the pulley on rotation of the ratchet member 58.

An entraining member 61 is also rotatably mounted in the housing 57 coaxially with the ratchet member 58. The entraining member 61 has an aperture 61*a* of a non-circular cross-sectional configuration which receives an end portion 26*a* of the connecting member 24 which has a compatible configuration. Thus, the entrainment member 61 shares in the angular displacement of the connecting member 24 and thus of the arm 5.

The entraining member 61 has a disc-shaped portion 62, and a spring 63 is provided which urges the entraining member 61 toward the ratchet wheel 58*b*, the spring 63 abutting the housing 57 at one of its ends and the disc-shaped portion of the entraining member 61 at its other end. The ratchet wheel 58*b* has a plurality of notches 64, and the disc-shaped portion 62 has at least one tooth 65 which engages one or the other of the notches 64 when the entraining member is in its rightwardly displaced position and thus entrains the ratchet member 58 for rotation therewith in one sense. The disc-shaped portion 62 also has a ridge 66 the purpose of which will be explained below.

A support member 67 is mounted on a guiding pin 68 for displacement parallel to the axis of the ratchet member 58. An operating lever 69 is mounted on the housing 57 for pivoting about a pivot 70 and extends toward the exterior of the trunk 2 through an elongated opening 3*a* of the shell 3. When the operating member 69 is pivoted in the counterclockwise direction, it will displace the support member 67 in the direction of the arrow, that is, leftwardly as seen in FIG. 5.

An arresting pawl 71 is mounted on the guiding pin 68 for pivoting thereabout, and a spring 72 urges the arresting pawl 71 into engagement with the ratchet wheel 58*b*. The cooperation of the arresting pawl 71 with the ratchet wheel 58*b* will prevent the ratchet member 58 from rotating in the opposite sense, so long as the support member is in the position illustrated in FIG. 5. Once the operating member 69 displaces the support member 67 leftwardly, against the force of a spring 73, two things will happen simultaneously or in succession. The support member 67 will engage the ridge 66 of the disc-shaped portion 62 of the entraining member 61 and push the latter in the leftward direction, as indicated by the arrow, until the tooth or teeth 65 disengage from the notches 64 of the ratchet wheel 58*b*. Thus, the entraining member 61 or the teeth 65 thereof become incapable of obstructing the rotation of the ratchet member 58 in one or the other sense. However, the arresting pawl 71 may still prevent the ratchet wheel 58*b* from rotating. Though, as the support member 67 is displaced by the operating member 69 leftwardly, so is the arresting pawl 71 which eventually disengages from the teeth of the ratchet wheel 58*b* and thus releases the ratchet member for free rotation. Since the spring 35 pulls the lower end plate 32 downwardly (see FIG. 1) and since a superatmospheric pressure exists in the interior of the bellows 29, the combined action of these forces on the flexible element 27 will withdraw the same from the ratchet mechanism 23 and thus rotate the ratchet member 58 back into its illustrated initial position of FIG. 5. If need be, the valve 38 will permit the supply of the air in the bellows 29 to be replenished. Once this happens, the entire cycle of operation can be repeated.

The housing 57 has at least one abutment 74 which delimits the extent of rotation of the entraining member 61 in that the ridge 66 abuts the same, at one end or the other and thus prevents further rotation of the entraining member 61 in one sense or the other. Of course, this also limits the extent of swiveling of the arm 5.

Finally, it is to be mentioned that as seen in FIG. 2, the shells 3 and 4 have respective projections 77 which together bound a groove for receiving the marginal portion of the upper end plate 30 of the pressurizing arrangement 28, thus positionally fixing the upper end plate 30 in the trunk 2. Mating positioning pins 78 and 79 assure the proper assembly of the shells 3 and 4 with one another and prevent the shells 3 and 4 from shifting relative to one another once assembled. Pins 80 have respective bores one of which is internally threaded while the associated one on the other shell section 3 or 4 is smooth. Non-illustrated screws extend through the smooth bores and engage the threads of the internally threaded bores to connect the shells 3 and 4 to one another.

It will be seen that there is provided an activity doll which achieves the various objects of the invention and which is well adapted to meet the conditions of practical use.

Inasmuch as various possible embodiments might be made of the above invention, and since various changes might be made in the embodiment set forth above, it is to be understood that all matter herein described or shown in the accompanying drawings is to be interpreted as illustrative only and not in a limiting sense. The scope of protection which is being sought will appear from the accompanying claims.

We claim:

1. A bubble-blowing doll, comprising a body including a head having a mouth opening; a ballon having an open end and a distensible end remote from the open end, and so mounted on the body that the open end is located within the body and the distensible end at the mouth opening; means for introducing a pressurized medium into said balloon through said open end to inflate said distensible end to the exterior of the head at the mouth opening; and means for selectively energizing the introducing means including an actuator having a ratchet wheel mounted in said body for rotation about an axis and an arresting pawl engaging said ratchet wheel and permitting the same to rotate in only one sense, said actuator further including a transmission interposed between the pressurizing means and the ratchet mechanism and activating the pressurizing means when the ratchet wheel rotates in said one sense.

2. The doll of claim 1, wherein said means for introducing said pressurized medium into said balloon includes means for communicating said pressurizing means with the interior of said balloon.

3. The doll of claim 2, wherein said pressurizing means includes a bellows.

4. The doll of claim 3, wherein said transmission includes a pulley connected to said ratchet wheel for joint rotation therewith at least in said one sense, and at least one flexible element so connected to said pulley as to be wound thereabout during the rotation of said pulley in said one sense, and to said bellows as to compress the same during the winding of said flexible element about said pulley.

5. The doll of claim 4, wherein said ratchet mechanism further includes an entraining pawl having at least one tooth; wherein said ratchet wheel has at least one detent; and wherein said entraining pawl is mounted on said body for rotation in both senses about said axis, and said tooth thereof engages said detent of said ratchet wheel when said entraining pawl rotates in said one sense, and disengages the same when said entraining pawl rotates in the opposite sense.

6. The doll of claim 5, wherein said entraining pawl has a disc-shaped portion having an axial end face carrying said tooth; wherein said ratchet wheel has an end surface juxtaposed with said end face of said disc-shaped portion and carrying said detent; wherein said entraining pawl is mounted on said body for displacement axially toward and away from said ratchet wheel; and further comprising means for axially displacing said entraining pawl at least in direction away from said ratchet wheel and for simultaneously disengaging said arresting pawl from said ratchet wheel to release the same for rotation in the opposite sense.

7. The doll of claim 6, wherein said displacing means includes a support member mounted in said body for movement in and opposite to said direction, carrying said arresting pawl for joint movement and engaging said entraining pawl on movement in said direction, and an operating member having an actuating portion accessible at the exterior of said body and an operating portion acting on said support member for moving the same at least in said direction upon actuation of said operating member.

8. The doll of claim 7, wherein said displacing means further includes means for urging said entraining pawl and said support member opposite to said direction, including at least one spring.

9. The doll of claim 4, wherein said bellows includes one end portion stationarily mounted in said body and another end portion distant from said one end portion; and wherein said transmission further includes and end member guided in said body for movement toward and away from said one end of said bellows, connected to said flexible element and extending across said other end of said bellows to act on the same at least while moving toward said one end of said bellows.

10. The doll of claim 9, and further comprising means for biasing said end member away from said one end of said bellows, including at least one spring connected to and extending between said end member and said body.

11. The doll of claim 3, wherein said pressurizing means further includes a one-way valve interposed between the interior and the exterior of said bellows and permitting ambient air to enter the interior of the bellows while preventing pressurized air from escaping therethrough to the exterior of said bellows.

12. The doll of claim 3, wherein said body includes a trunk and four limbs at least one of which is mounted on said trunk at least for a limited swiveling movement relative thereto; and wherein said one limb constitutes a part of said actuator.

13. The doll of claim 12, wherein said one limb has a portion received within said trunk and having a transverse recess; and wherein said ratchet mechanism has an elongated protuberance which is received in said transverse recess for joint swiveling with said one limb and drives said ratchet wheel in rotation about said axis.

14. The doll of claim 3, wherein said communicating means includes a conduit and a reed sealingly embracing a portion of said conduit; and wherein said open end of said balloon is mounted on said reed.

15. The doll of claim 14, wherein said reed has an external circumferential rim; and wherein said balloon is so mounted on said reed that said open end thereof engages behind said circumferential rim.

16. The doll of claim 14, wherein said reed has a free end which is substantially flush with said mouth opening of said head.

17. The doll of claim 14; and further comprising means for ejecting said reed with said balloon mounted thereon to the exterior of said head through said mouth opening, including an ejecting member mounted in said head for movement along said portion of said conduit and having an actuating end substantially opposite said mouth opening.

18. The doll of claim 17; and further comprising a mouthpiece within said head surrounding said portion of said conduit and said reed and preventing said balloon from expanding within said head, said mouthpiece having an open end which is substantially flush with the mouth opening of said head; and wherein said ejecting member is partially accommodated in said mouthpiece to be guided thereby during its movement.

* * * * *